US008872648B2

(12) United States Patent
Oppelt et al.

(10) Patent No.: US 8,872,648 B2
(45) Date of Patent: Oct. 28, 2014

(54) FIRE DETECTOR WITH A MAN-MACHINE INTERFACE AND METHOD FOR CONTROLLING THE FIRE DETECTOR

(71) Applicant: Robert Bosch GmbH, Stuttgart (DE)

(72) Inventors: Ulrich Oppelt, Zorneding (DE); Bernd Siber, Baiern-Antholing (DE); Muhammed Ali Narin, Haar (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/757,902

(22) Filed: Feb. 4, 2013

(65) Prior Publication Data

US 2013/0201017 A1 Aug. 8, 2013

(30) Foreign Application Priority Data

Feb. 3, 2012 (DE) ..... 10 2012 201 589

(51) Int. Cl.
*G08B 29/00* (2006.01)
*G08B 29/04* (2006.01)
*G08B 17/00* (2006.01)

(52) U.S. Cl.
CPC ..... *G08B 17/00* (2013.01); *G08B 29/043* (2013.01)
USPC ..... 340/514; 340/628; 340/632; 340/686.6

(58) Field of Classification Search
CPC ..... G08B 19/005; G08B 17/00; G08B 17/10; G08B 17/103; G08B 17/107; G08B 17/11; G08B 17/12; G08B 29/145
USPC ..... 340/514, 628, 629, 630, 632
See application file for complete search history.

(56) References Cited

U.S. PATENT DOCUMENTS

| | | | | |
|---|---|---|---|---|
| 4,901,056 | A * | 2/1990 | Bellavia et al. | 340/514 |
| 6,348,871 | B1 * | 2/2002 | Tanguay et al. | 340/628 |
| 7,239,236 | B1 * | 7/2007 | Britton | 340/514 |
| 7,710,256 | B2 * | 5/2010 | Tawil | 340/514 |

FOREIGN PATENT DOCUMENTS

| | | |
|---|---|---|
| DE | 10066246 | 10/2005 |
| DE | 102006023048 | 11/2007 |
| DE | 102009047531 | 6/2011 |

* cited by examiner

*Primary Examiner* — Anh V La
(74) *Attorney, Agent, or Firm* — Michael Best & Friedrich LLP

(57) ABSTRACT

A fire detector having a fire sensor device for detecting a fire and for outputting a fire signal. The fire detector also has an environmental sensor device for detecting bodies in the environment of the fire detector and for outputting an environmental signal. A control device sets a normal state and an alarm state of the fire detector on the basis of the fire signal, the fire detector additionally being in the form of a man-machine interface, and the control device checking whether the environmental signal can be deemed to be a user input.

18 Claims, 2 Drawing Sheets

FIRE DETECTOR WITH A MAN-MACHINE INTERFACE AND METHOD FOR CONTROLLING THE FIRE DETECTOR

BACKGROUND OF THE INVENTION

The invention relates to a fire detector having a fire sensor device for detecting a fire and for outputting a fire signal, having an environmental sensor device for detecting bodies in the environment of the fire detector and for outputting an environmental signal, and having a control device which sets a normal state and an alarm state of the fire detector on the basis of the fire signal. The invention also relates to a method for controlling the fire detector.

Fire detectors are used in private facilities, public areas or industrial environments in order to detect a fire in an environment in good time and to output an alarm. In conventional designs, fire detectors comprise a housing with an integrated sensor system which is designed to detect characteristic fire parameters. Since smoke or heat usually collects in the ceiling area of a room, it is conventional to position the fire detectors on the ceiling.

In order to ensure functionality of the fire detector, it must be set up in such a manner that it is not covered and is at a distance from objects in the environment. For example, relevant application standards, for example DIN VBE 0833-2 or DIN 14676, require fire detectors to be positioned in such a manner that no objects which could impair a proper method of operation are present within 50 cm of the detectors.

In principle, it is necessary to regularly perform tests in which a check is carried out in order to determine whether the environment of the fire detectors meets the requirements. However, when fire detectors are used in private households for example, it cannot be reliably assumed that such a test is actually carried out.

The document DE 10 2009 047 531 A1, which is probably the closest prior art, describes a smoke detector with ultrasonic antimasking, the smoke detector having, in addition to a smoke detection sensor, at least one ultrasonic sensor which is arranged in such a manner that it emits ultrasonic signals at least to the side and in a manner facing away from the ceiling or wall and can receive reflected ultrasonic signals and, in this manner, can check whether the environment is free of objects.

SUMMARY OF THE INVENTION

The fire detector according to the invention is designed to trigger an alarm in the event of a fire in its environment. It is, in particular, an automatic fire detector which can detect the fire on the basis of the characteristic fire parameters of the latter. The characteristic fire parameters include, for example, the ambient temperature, smoke concentration, and optical emissions of the fire.

The fire detector comprises a fire sensor device which is designed to detect a fire and to output a fire signal. The fire sensor device has one or more sensor systems for detecting the characteristic fire parameters. The fire sensor device preferably comprises an optical or photoelectric smoke sensor system which detects smoke as a characteristic fire parameter according to the scattered light method. Such a sensor system is disclosed, for example, in DE 10 2009 047 531 A1 cited at the outset. However, other sensor systems may also be used.

The fire detector additionally comprises an environmental sensor device for detecting bodies in the environment of the fire detector and for outputting an environmental signal. The environmental sensor device checks the environment of the fire detector and outputs a positive environmental signal in the presence of a body as an interfering contour. The environmental sensor device particularly preferably outputs an item of location information relating to the body, in particular an item of distance information, that is to say the distance between the fire detector and the detected body, and/or an item of spatial angle information or partial space information relating to the spatial angle or partial space at or in which the body was detected.

The fire detector also comprises a control device which sets a normal state and an alarm state of the fire detector on the basis of the fire signal. As long as the fire signal from the fire sensor device does not satisfy particular predefinable conditions, it is assumed that there is no fire and the fire detector is thus set to the normal state. If the fire signal is such that it is possible to infer a fire in the environment, the fire detector is set to the alarm state. In response to the fire detector being set to the alarm state, an acoustic alarm signal is output, for example, and/or an alarm message is passed, for example via a network, in particular a safety network, to a monitoring center which can then take further measures.

In addition to the function as a fire detector, the invention proposes that the fire detector is in the form of a man-machine interface (MMI), the control device checking whether the environmental signal can be deemed to be a user input.

In particular, within the scope of its basic function, the environmental sensor device is not only intended to detect interfering contours, but the fire detector is intended to be designed in such a manner that a user can deliberately cause an environmental signal, in particular a positive environmental signal, in the environmental sensor device, that the control device checks this signal in order to determine whether it can be deemed to be a user input and that the fire detector is controlled by the user input if the check is positive. The check is carried out, for example, on the basis of predefinable conditions which must be satisfied by the environmental signal and/or the fire detector.

The advantage of the invention can be seen in the fact that the environmental sensor device is given a dual function. On the one hand, it is used—as already known—to detect interfering contours. On the other hand, the environmental sensor device is used to control the fire detector via the control device. For example, in the event of an alarm state of the fire detector, a user can—at least briefly—reset the alarm state by causing a positive environmental signal. Other possibilities for control operations by means of a user input via the environmental signal are also stated below.

It is particularly advantageous in the invention that the user input is made in a contactless manner via the environmental sensor device, with the result that the user need not physically make contact with the fire detector. Such fire detectors are often fitted to the ceiling and therefore cannot be reached by normal adults without aids. In order to thus achieve a user input in the case of conventional fire detectors, the user must first of all fetch an aid, for example a ladder or a chair, and can then only operate the fire detector. In contrast, when the environmental sensor device is used as part of the man-machine interface, it may be sufficient to cause the positive environmental signal from a certain distance from the fire detector and to thereby make the user input.

Sensors which can be used for the environmental sensor device are, for example, optical sensors, for example in the infrared range, or according to the reflection principle, that is to say microwave sensors. However, at least one ultrasonic sensor is particularly preferably used. The function of detecting bodies and measuring the distance by means of ultrasound is carried out by determining the propagation time and is known, for example, from reversing sensors or parking aids of motor vehicles, which are based on ultrasonic sensors. In the case of the ultrasonic sensors, a transmission pulse (burst) is emitted and the signal reflected by the body is received. The existence of the body, on the one hand, and the distance between the body and the fire detector, on the other hand, are inferred from the propagation time of the signal from emission to reception. Such ultrasonic sensors have become available in the meantime in a very cost-effective and extremely reliable form.

In one possible development of the invention, the control device is designed, in particular in terms of programming and/or circuitry, to deem the environmental signal to be a user input if the environmental signal changes during the alarm state. Therefore, at least two conditions must be satisfied for the environmental signal to be deemed to be a user input, namely that the fire detector is set to the alarm state and the environmental signal changes.

The change in the environmental signal may represent, for example, coding of the environmental signal. For example, it is possible that the environmental signal must be regularly changed so that it is deemed to be a user input. It is also possible that the environmental signal must be changed according to a predefinable pattern in order to be deemed to be a user input. For example, a user could change the environmental signal in such a manner that a Morse code is produced in the environmental signal.

In one possible refinement of the invention, the control device is designed in such a manner that the environmental signal is deemed to be a user input if a body is redetected in the environment during the alarm state. Therefore, at least two conditions must be satisfied for the environmental signal to be deemed to be a user input, namely that the fire detector is set to the alarm state and the body is redetected from the environmental signal. For example, it is possible for a user to resort to the fire detector in the alarm state, the user forming the redetection of the body by his presence and the overall operation being deemed to be the user input.

In further refinements of the invention, it is possible for the control device to be designed to deem the environmental signal to be a user input if a or the body moves along a movement path in the environment of the fire detector. For example, one condition could be for the user to run around the fire detector once. Such a condition would exclude an incorrect assessment by the control device with a high degree of reliability.

It is particularly preferred for the movement path of the body to require an active or dependent movement of the body so that the control device deems the resultant environmental signal to be a user input. A dependent movement of the body can be understood as meaning, for example, a movement which results in an increase in the potential energy of the body or has a frequency change in the height position. An active movement is understood as meaning, for example, a movement which has a frequency change in the movement speed or the direction of movement. For example, a condition may be configured such that the environmental signal is caused by the user waving. Other movement paths which differ considerably from possible movement paths of objects in a room in the event of a fire may also be used. Such movement paths cannot be effected without interaction of the user, with the result that such a condition would exclude an incorrect evaluation by the control device with a high degree of reliability.

In one possible development of the invention, the control device is designed to deem only an environmental signal from a partial space region in the environment of the fire detector to be a user input. One condition for deeming the environmental signal to be a user input is therefore that the environmental signal must be caused by interaction of the user in the partial space region. For example, it is possible for the partial space region to be in the form of a partial angular region, with the result that the user must interact in order to cause the environmental signal in the partial angular region. In another alternative or addition, the partial space region is a distance region, the user having to carry out the action for causing the environmental signal at a particular distance from or in a particular distance region with respect to the fire detector. For example, provision may be made for only interactions of the user at a distance of between 50 cm and 1.50 m from the fire detector to be checked as a possible user input. This embodiment has the advantage that random environmental signals in other partial space regions, which could be caused by the user, are filtered out.

In one particularly preferred embodiment of the invention, the user input is in the form of a reset signal in order to reset the alarm state of the fire detector. In this case, provision may either be made for the alarm state to be permanently reset and, in particular, to be reset to the normal state or for the alarm state to be reset to an intermediate state, which lasts for 30 seconds for example and then returns to the alarm state again, or to be reset to the normal state. In this refinement, it is therefore possible for the user to change the alarm state of the fire detector via the environmental signal, in particular to deactivate the alarm state briefly or permanently. In practice, this embodiment can be used if there is a false alarm, for example, and the user would like to end the alarm state quickly.

In one possible development of the invention, the control device is designed to set an operating state and a fault state of the fire detector on the basis of the environmental signal, the user input being in the form of a service signal in order to reset the fault state of the fire detector. In this possible development or refinement of the invention, the environmental signal is first of all used by the control device in order to detect whether interfering contours are arranged at a predefinable distance of 50 cm, for example. As explained at the outset, interfering contours may restrict the operational reliability of the fire detector or are formally not allowed by corresponding standards. If there are interfering contours, the fire detector is set to a fault state from an operating state, an optical signal or an acoustic signal, for example, being output by the fire detector in the fault state. Alternatively, it is also possible for the fault state to be transmitted to a monitoring center via the network described at the outset. In this development, it is now possible to reset the fault state of the fire detector via the fire detector in the form of the man-machine interface and to either reset the fire detector to the operating state or to set the fire detector to an intermediate state again, for example, in order to eliminate the fault, in particular the interfering contour.

The invention also relates to a method for controlling the fire detector as described above or according to one of the preceding claims, a user causing an environmental signal by interacting with the environmental sensor device, and the environmental signal caused in this manner being checked by the control device in order to determine whether the environmental signal can be deemed to be a user input. In particular, the method comprises the intended use of the fire detector as described above.

BRIEF DESCRIPTION OF THE DRAWINGS

Further features, advantages and effects of the invention emerge from the following description of a preferred exemplary embodiment of the invention and the figures, in which.

DETAILED DESCRIPTION

Figure 1:
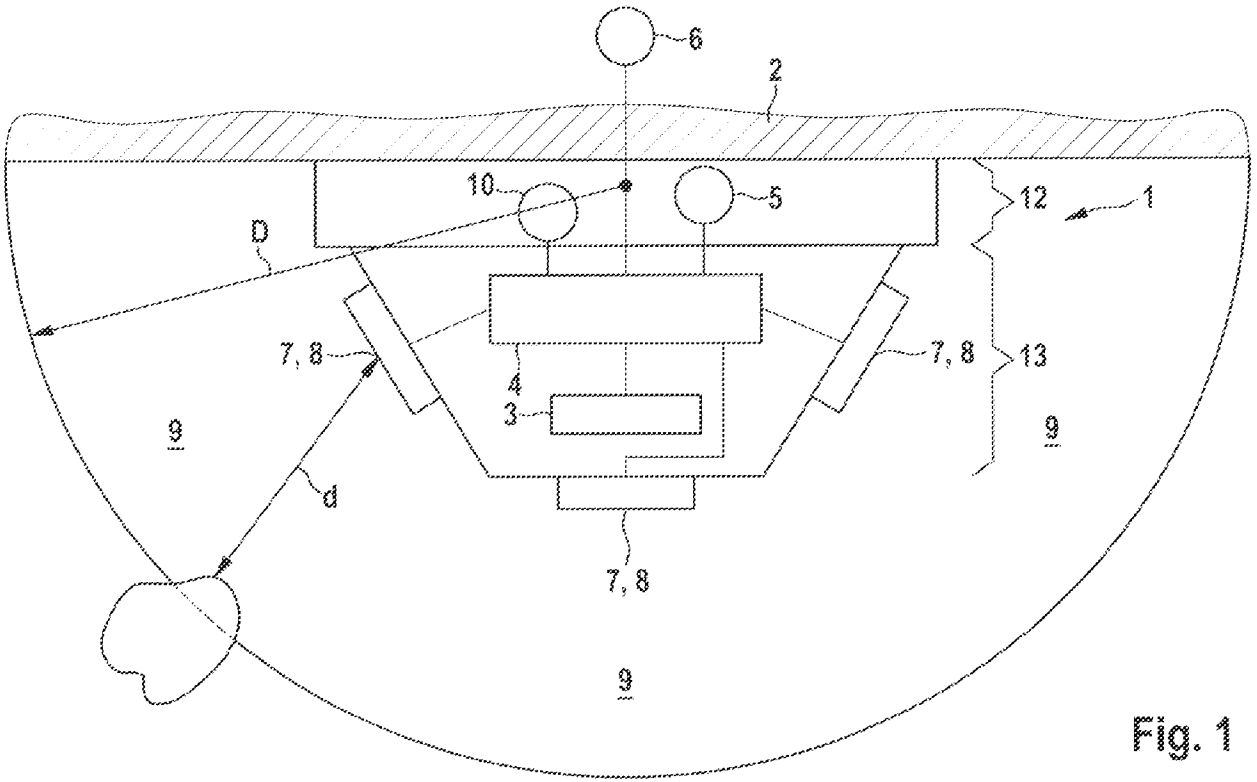
FIG. 1 shows a schematic side view of a fire detector as a first exemplary embodiment of the invention.

FIG. 1 shows, in a highly schematic manner, a fire detector 1 as one exemplary embodiment of the invention, which fire detector is mounted on a ceiling 2 of a room, generally referred to as an environment. The fire detector 1 is designed to detect fires and has a fire sensor device 3 which comprises, for example, a smoke sensor according to the scattered light principle. Such a smoke sensor has a transmitting device and a receiving device, the transmitting device emitting an optical signal in such a manner that it is not directly incident on the receiving device. If smoke particles now enter the region between the transmitting device and the receiving device, the optical signal is scattered at the smoke particles and enters the receiving device. The fire sensor device 3 provides a fire signal from the fire sensor.

The fire detector 1 also comprises a control device 4 to which the fire signals are passed and which can change over the fire detector 1 from a normal state to an alarm state or vice versa. The fire detector 1 is normally in a normal state. If the fire sensor device 3 generates a fire signal which indicates a characteristic fire parameter, for example smoke, the control device 4 evaluates the fire signal and sets the fire detector 1 to the alarm state.

Depending on the embodiment, the control device 4 may be connected to an acoustic signal generator 5, for example a siren which is integrated in the fire detector 1 and outputs an alarm tone, or may be connected, via a network 6, to a monitoring center (not illustrated) to which the state, in particular the normal state or the fire state, of the fire detector 1 is transmitted.

The fire sensor device 3 may also comprise further sensors for detecting characteristic fire parameters or, instead of the smoke detector described, may have another sensor for detecting characteristic fire parameters.

The fire detector 1 has an environmental sensor device 7 which is formed from a plurality of ultrasonic sensors 8, the transmitting and receiving ranges of which extend in different, but overlapping (in this exemplary embodiment), spatial angle regions. The spatial angle regions form monitoring regions 9 of the ultrasonic sensors 8. The environmental sensor device 7 is designed to detect bodies K in the spatial angle regions 9 and to output an environmental signal to the control device 4. If a body K is detected in one of the monitoring regions 9, the environmental signal contains an item of information relating to the existence of the body and its distance d from the detecting ultrasonic sensor 8.

The control device 4 evaluates the environmental signal from the environmental sensor device 7 and, in conventional embodiments, sets an operating state for the fire detector 1 if no bodies K have been detected as interfering contours at a distance D around the fire detector 1. If a body K is detected within the distance D when evaluating the environmental signal, the fire detector 1 is set to a fault state. In the fault state, either a warning signal is output via the acoustic signal generator 5, an optical signal is output via an optical signal generator 10 or the fault state is transmitted to the fire center via the network 6.

The ultrasonic sensors 8 may be fitted, for example, to a detector base 11 or, as shown in FIG. 1, to a sensor cap 12 which also has the fire sensor device 3, or, in other exemplary embodiments, in or to a component which is arranged in the immediate vicinity of the fire detector 1.

In addition to the described basic function of the environmental sensor device 7, the latter forms part of a man-machine interface which makes it possible for a user to make a user input on the control device 4 of the fire detector 1, with the result that the fire detector 1 implements an additional function.

The control device 4 is designed to check the environmental signal from the environmental sensor device 7 in order to determine whether the environmental signal can be deemed to be a user input. In order to be able to distinguish between an interfering contour and a user input, different conditions which are described below can be checked in the control device 4. In this case, the control device 4 may be designed such that at least one, some or all of the following conditions must be satisfied in order to deem the environmental signal to be a user input. In particular, the control device 4 may be designed such that any desired selection of the following conditions must be satisfied.

A first possible condition relates to the signaling state of the fire detector 1. In the case of this condition, a check is carried out in order to determine whether the fire detector 1 is in a normal state or in an alarm state. In the case of this condition, an environmental signal can be deemed to be a user input only when the fire detector 1 is in an alarm state. This condition is based on the consideration that it is entirely conventional for the environmental sensor device 7 to detect a body and to output a corresponding environmental signal when the fire detector 1 is in a normal state. As soon as the fire detector 1 has switched to an alarm state, it is assumed that an environmental signal which indicates a body in the monitoring region 9 can be attributed to interaction of the user with the environmental sensor device 7 and can therefore be deemed to be a user input.

In the case of a second possible condition, a check is additionally carried out in order to determine whether the environmental signal changes during the alarm state. In particular, a check is carried out in order to determine whether a body is redetected in the environment during the alarm state.

In the case of a third possible condition, a check is carried out in order to determine whether a movement of a or the body along a movement path in the environment of the fire detector 1 can be derived from the environmental signal. If such a movement path is determined, the environmental signal is deemed to be a user input. In particular, it is possible to check whether the movement path of the body corresponds to a predefined movement path or predefined criteria for the movement path. On the one hand, this makes it possible to exclude movement paths of interfering contours since an "unnatural", dependent or active movement of the body is required for the movement path. One criterion for the movement path may be a movement of the body counter to gravity, with the result that objects which fall over in a fire, for example cabinets etc., do not result in an assessment as a user input. In contrast, with a movement path counter to gravity, it can be assumed that this was produced by the user interacting with the environmental sensor device 7. Another criterion for the movement path of the body may also be, for example, regular waving or another movement path which is not automatically carried out by a body.

In the case of a fourth condition, a check is carried out in order to determine whether the environmental signal has been generated by a body in a partial space region in the environment. The environmental signal is deemed to be a user input only if the body in the partial space region caused the environmental signal.

Figure 2:
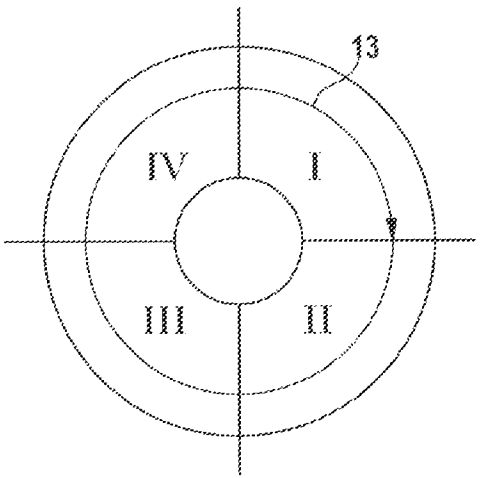
FIG. 2 shows a plan view of the fire detector from FIG. 1 from above with its environment.

If FIG. 2, which shows a schematic plan view of the fire detector 1, is considered for example, the environment can be subdivided into four quadrants I-IV, for example, only environmental signals which were generated by a body in one of the quadrants I-IV being deemed to be a user input. In one possible development, it is conceivable, for example, for a body to have to carry out a movement path through a plurality of or all quadrants according to arrow 13 so that the environmental signal is deemed to be a user input. Alternatively, it is also possible for only environmental signals which were generated on account of a body in the central monitoring region 9 (FIG. 1, center) to be deemed to be a user input.

Figure 3:
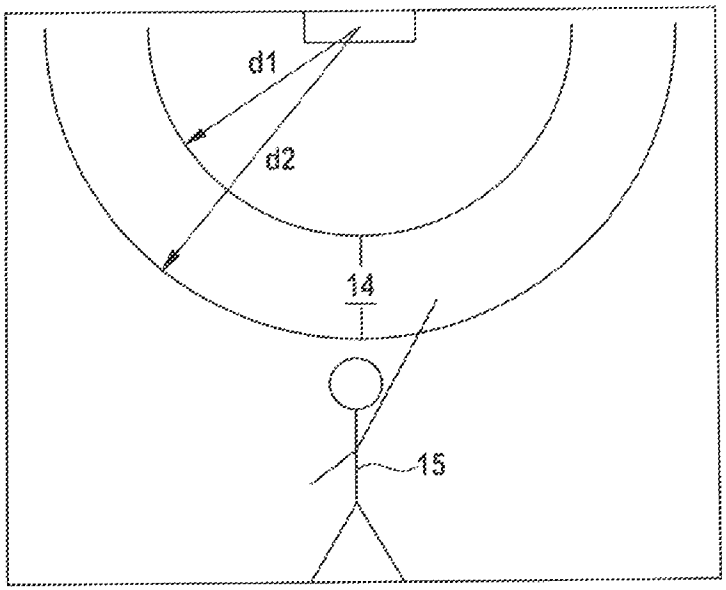
FIG. 3 shows a side view of the fire detector in FIG. 1 in its environment.

FIG. 3 shows a schematic side view of the environment and the fire detector 1, a distance region 14 being defined as the partial space region in a schematic manner. The distance region 14 begins, for example, at a distance d1 from the fire detector 1 which is greater than the distance usually used to detect an interfering contour and is thus greater than 50 cm, preferably greater than 70 cm. The distance region 14 is bounded to the outside at a distance d2, with the result that the distance region 14 is bounded to the outside, for example, with a distance d2 of less than 1.20 m, preferably less than 1 m. This definition of the partial space region is based on the consideration that an interfering contour usually cannot be expected in the distance region 14, with the result that interaction by a user 15 can be inferred in the case of a positive environmental signal. For example, the user 15 can enter the distance region 14 using a hand and can produce the corresponding environmental signal there. If the two conditions according to FIG. 2 and FIG. 3 are combined for example, the distance region 14 is limited to a quadrant region II, with the result that interaction of the user 15 with the environmental sensor device 7 for producing an environmental signal which can be deemed to be a user input is limited to this narrow partial space region.

The user input may result—if the fire detector 1 is in the alarm state—in the alarm state being reset to the normal state, for example. This can be advantageously used when the fire detector 1 has a false alarm, with the result that the fire detector can be reset without the user 15 having to mechanically operate the fire detector 1. An alternative or additional embodiment provides for the user input to result in the fault state of the fire detector 1 being reset.

The invention claimed is:

1. A fire detector comprising a fire sensor device for detecting a fire and for outputting a fire signal, an environmental sensor device for emitting a signal to detect bodies in the environment of the fire detector and for outputting an environmental signal, and a control device which sets a normal state and an alarm state of the fire detector on the basis of the fire signal, wherein the fire detector is additionally in the form of a man-machine interface, the control device being designed to check whether the environmental signal can be deemed to be a user input.

2. The fire detector according to claim 1, wherein the environmental sensor device comprises at least one ultrasonic sensor, the ultrasonic sensor detecting bodies and measuring a distance from the bodies by determining propagation time of the signal from emission to reception.

3. The fire detector according to claim 1, wherein the control device is designed to deem the environmental signal to be the user input if the environmental signal changes during the alarm state.

4. The fire detector according to claim 1, wherein the control device is designed to deem the environmental signal to be the user input if a body is redetected in the environment during the alarm state.

5. The fire detector according to claim 1, wherein the control device is designed to deem only an environmental signal from a partial space region in the environment to be a user input.

6. The fire detector according to claim 1, wherein the environmental sensor device outputs the environmental signal comprising an item of spatial angle information relating to the spatial angle at which the body was detected.

7. The fire detector according to claim 1, wherein the control device sets an operating state and a fault state of the fire detector on the basis of the environmental signal, the user input being in the form of a service signal in order to reset the fault state of the fire detector.

8. The method for controlling the fire detector according to claim 1, wherein the environmental sensor device outputs an environmental signal comprising a distance between the fire detector and a detected body, and the environmental signal is checked by the control device in order to determine whether the environmental signal can be deemed to be a user input.

9. A fire detector having a fire sensor device for detecting a fire and for outputting a fire signal, having an environmental sensor device for detecting bodies in the environment of the fire detector and for outputting an environmental signal, and having a control device which sets a normal state and an alarm state of the fire detector on the basis of the fire signal, wherein the fire detector is additionally in the form of a man-machine interface, the control device being designed to check whether the environmental signal can be deemed to be a user input, wherein the control device is designed to deem the environmental signal to be the user input if a or the body moves along a movement path in the environment of the fire detector.

10. The fire detector according to claim 9, wherein the movement path of the body requires an active or dependent movement of the body.

11. A fire detector comprising:

a fire sensor device configured to detect a fire and for outputting a fire signal;

an environmental sensor device configured to detect a presence of bodies in an environment of the fire detector in a contactless manner and for outputting an environmental signal, the presence of a body being sensed as an interfering contour; and a control device configured to set a normal state or an alarm state of the fire detector on the basis of the fire signal, the control device being configured to determine whether the environmental signal comprises a user input, and when a user input is determined, the control device being configured to reset from the alarm state to the normal state for at least a brief period of time.

12. The fire detector of claim 11, wherein the environmental device comprises an ultrasonic sensor disposed adjacent the fire sensor device, the ultrasonic sensor detecting bodies and measuring a distance of the bodies by determining propagation time.

13. The fire detector of claim 12, wherein the interfering contours are detected in a contactless manner at a distance of between 50 cm and 1.5 m from the environmental sensor device.

14. The fire detector of claim 13, wherein the control device requires that the body move along a movement path within the distance from the environmental sensor device to determine a user input.

15. The fire detector of claim 11, wherein the environmental sensor device outputs an environmental signal comprising a distance between the fire detector and a detected body, and the environmental signal is checked by the control device in order to determine whether the environmental signal can be deemed to be a user input.

16. The fire detector of claim 15, wherein the environmental sensor device outputs an environmental signal comprising an item of spatial angle information relating to the spatial angle at which the body was detected.

17. The fire detector of claim 11, the fire detector further comprising:

a network connected to the control device, the network for providing signals to a remote monitoring center during the alarm state; and an acoustic siren connected to the control device for providing an acoustic alarm during the alarm state.

18. The fire detector of claim 11, wherein the environmental sensor device outputs an environmental signal comprising an item of spatial angle information relating to the spatial angle at which the body was detected.

* * * * *